US005230579A

United States Patent [19]

Klawson et al.

[11] Patent Number: 5,230,579

[45] Date of Patent: Jul. 27, 1993

[54] POROUS DOME APPLICATOR WITH PUSH/PULL CAP

[75] Inventors: Rennold L. Klawson, Middletown; Terence J. Franta, Hamilton Square, both of N.J.

[73] Assignee: Carter-Wallace, Inc., New York, N.Y.

[21] Appl. No.: 717,757

[22] Filed: Jun. 19, 1991

[51] Int. Cl.[5] ..... A45D 34/00

[52] U.S. Cl. ..... 401/205; 401/202

[58] Field of Search ..... 401/202, 205, 277, 280, 401/208

[56] References Cited

U.S. PATENT DOCUMENTS

| | | | |
|---|---|---|---|
| 673,918 | 5/1901 | Murray | 401/205 |
| 1,481,733 | 1/1924 | Paull . | |
| 2,669,740 | 2/1954 | Main | 401/277 |
| 2,853,727 | 9/1958 | Nadai | 15/134 |
| 2,853,728 | 9/1958 | Nadai | 15/134 |
| 3,106,742 | 10/1963 | Schultz et al. | 401/202 |
| 3,133,309 | 5/1964 | Miles | 15/565 |
| 3,281,887 | 11/1966 | Raffe | 401/205 |
| 3,482,920 | 12/1969 | Schwartzman | 401/132 |
| 4,050,826 | 9/1977 | Berghahn et al. | 401/196 |
| 4,111,567 | 9/1978 | Berghahn et al. | 401/202 |
| 4,384,589 | 5/1983 | Morris | 132/88.5 |
| 4,475,837 | 10/1984 | Bornbusch et al. | 401/213 |
| 4,480,940 | 11/1984 | Woodruff | 401/206 |
| 4,859,104 | 8/1989 | Roeder et al. | 401/202 |
| 4,936,700 | 6/1990 | Morris | 401/196 |
| 5,051,016 | 9/1991 | Bengston | 401/208 X |

FOREIGN PATENT DOCUMENTS

| | | | |
|---|---|---|---|
| 1420454 | 11/1965 | France | 401/205 |
| 1461651 | 12/1966 | France | 401/205 |
| 2232074 | 12/1990 | United Kingdom | 401/202 |

*Primary Examiner*—Steven A. Bratlie
*Attorney, Agent, or Firm*—Watov & Kipnes

[57] ABSTRACT

A dispenser for liquids includes a dispenser head having an upper section captively mounted upon a lower section over a container of liquid to be dispensed. Removal of a cap from the dispenser head causes the upper section to move upward upon the lower section, for moving a plug out of a fluid flow channel or orifice. When the container is inverted in this open condition, liquid flows out of the container, through the orifice, and wets a rigid porous applicator mounted on top of the dispenser head upper section, for dispensing the liquid. When the cap is replaced on the dispenser head, its upper section is moved downward upon the lower section, causing the plug to enter and seal off the orifice, thereby closing the dispenser.

17 Claims, 8 Drawing Sheets

POROUS DOME APPLICATOR WITH PUSH/PULL CAP

FIELD OF THE INVENTION

The field of the present invention relates generally to liquid applicators, and more particularly to such applicators that are activated by removal of a cap, and placed in an inactive or sealed state via reapplication of the cap to the container.

BACKGROUND OF THE INVENTION

Liquid applicators are well known in the prior art. Many different types of applicators have been developed for applying liquids such as underarm deodorants, glues, cosmetics, and so forth. A number of examples of such prior applicator devices are given below.

Paull, U.S. Pat. No. 1,481,733 discloses a collapsible container 1 that includes a partially closed top portion having a centrally located circular orifice 3. The outer circumferential portion of the top includes an upwardly extending circular flange-like wallmember that includes a groove for captively retaining a circular piece of cloth or foraminous material 6 in an elevated position over the top of the container. In this manner, when the container is squeezed, the material dispersed from the orifice 3 wets the cloth 6, thereby permitting the cloth covering 6 to serve as the transfer medium for dispensing the material upon a surface. A cap 7 is provided for screwing over the top of the container and sealing the same from the air, in order to prevent the material left on the cloth 6 from drying out.

Nadai, U.S. Pat. No. 2,853,727 teaches the use of a porous membrane 32 for dispensing liquids from a container 10. A closure cap 40 is screwed over the top of the dispensing head for sealing off the membrane 32 during times when the dispenser is in a storage mode. Note that in another embodiment of the disclosed invention, a non-porous member 248 made of an elastic material with product flow holes 250 therethrough as shown in FIG. 4, is taught as an alternative to use of the porous membrane 32.

Nadai, U.S. Pat. No. 2,853,728 also teaches the use of a porous or absorbent type dispensing head with a applicator for dispensing liquids. As taught, the dispensing head includes a substantially closed off transverse wall 14 having a centrally located aperture for permitting product to flow from the container through the aperture and into the porous portions of the head member. These porous portions include in one embodiment a liquid permeable disc 24 captively retained within a well formed by a circular rib-like member 16. A larger liquid permeable circular disc-like applicator member 28 overlies the smaller disc 24 and is captively retained within a well-like portion of the applicator head formed by a circular flange 18, as shown. A fabric sheet 38 is used to cover the outermost portion of the porous disc 28 and is captively retained within a channel formed in the upper portion of the flange 18, as shown in FIG. 2. A dust cap 46 is screwed onto the dispensing head when the container is not in use.

Miles, U.S. Pat. No. 3,133,309 discloses a dispenser head for an applicator for dispensing liquids that includes a lowermost cup like member 23, which cup member 23 includes a lowermost centrally located aperture 31 for permitting fluid to flow from the lower container into the cup. In one embodiment, a sponge like material 35 in the shape of a cylindrical pellet is forced into the cup 23, as shown. Prior to placing the sponge 35 into the cup it is covered with a covering 37 that is porous, such as cloth made of polyethylene. The cup 23 is adapted for snap fitting into the top opening of the associated container 11 as shown in FIG. 1. A cap 45 is screwed over the head when the container is not in use.

Schwartzman, U.S. Pat. No. 3,482,920 discloses a liquid applicator container including a porous dispensing head body 26 made of polyurethane foam that is captively held within a circular groove of a flange 14 at the top of the applicator. A retaining ring 12 at the upper portion of the underlying container 16 provides a bottom support for the porous body 26. The retaining ring 12 has a centrally located weakened portion 18 for sealing off the lower container 16 prior to a first use of the container. When a user wishes to begin using the applicator, the top 36 is forced downward, causing the pointed end 41 of an extending centrally located projection 39 to pierce through the foam applicator 26 and break through the weakened portion 18 of the retaining or sealing ring 12, thereby providing a fluid flow aperture or channel, for permitting the applicator to be used when the cap 36 is thereafter removed.

Berghahn et al, U.S. Pat. No. 4,050,826 discloses a liquid applicator having a non-flexible, non-deformable, sintered porous synthetic plastic resin applicator head 4, captively retained in the top portion of the dispensing head, as shown. A screw-on cap 8 is provided when the applicator is not in use for covering and protecting the applicator head.

Berghahn, U.S. Pat. No. 4,111,567 teaches an invention similar to that disclosed in the immediately above-described U.S. Pat. No. 4,050,826. The major difference appears to be the use of a venting channel 40 in the applicator element 4 or 4', and the addition of a cup-like member 35 in the lower portion of the upper end of the applicator container, as shown.

Morris, U.S. Pat. No. 4,384,589 discloses an applicator device for applying liquids to a surface. The lower reservoir 10 of the applicator in one embodiment includes an absorbent material such as cotton, polyester, and so forth, for continuously supplying on demand via capillary flow (wicking) fluid from the reservoir to an upper rigid porous dispensing head 20. The dispensing head is made from either "Porex" or "Porous Poly", which are commercially available products under those trademarks. A cap 14 is provided that includes in its upper interior portion an absorbent layer 34 for assisting in absorbing any excess fluid that may pass through the porous head 24.

Dornbusch et al, U.S. Pat. No. 4,475,837 discloses a roll-on type applicator having a specially designed sealing cap. An exploded assembly view of the sealing mechanism is shown in FIG. 1, and a detailed cross-section is shown in FIG. 2 of the upper portion of the applicator with the cap applied. When the cap is placed on the container, it causes the ball to seal against the product flow passage way to prevent leakage of the product.

Woodruff, U.S. Pat. No. 4,480,940 discloses an applicator having a poromeric plastic applicator head. An annular elastic spring 35 is included for receiving the porous plastic applicator head 20. The spring and head are arranged in a manner to permit the head to move into the container 10 when pressure is applied to the top of the head 20, for providing a positive pressure for assisting in moving liquid from the container through the head 20 for easing the application of the liquid to a surface.

Roeder, et al, U.S. Pat. No. 4,859,104 discloses an applicator device for applying nail polish. A closing cap includes a reservoir for retaining nail polish, whereby when the cap is installed over a coating member, the reservoir opens for maintaining the coating member moist with the liquid or polish to be dispensed. When the closing cap is pulled away from the coating member, the reservoir is closed off to prevent leakage, and the coating member is exposed for permitting one to apply the polish that is on the coating member. To remoisten the coating member, it must be reinstalled upon the cap.

Morris, U.S. Pat. No. 4,936,700 teaches an invention similar to that of Morris, U.S. Pat. No. 4,384,589. An applicator includes a porous plastic applicator head and a liquid impervious closure cap adapted for fitting on top of a container. As in the related patent, the cap includes an absorbent pad in its crown for absorbing any excess liquid or vapor.

SUMMARY OF THE INVENTION

An object of the invention is to provide an improved liquid dispenser.

With this and other objects in mind, one embodiment of the present invention includes a dispenser with an applicator head including closure means that is movable downward via installation of a cover cap over the applicator head for the underlying container of liquid, for sealing off a product flow channel between the container and the applicator head. Upon removal of the cap, the closure means automatically moves upward as the cap is being removed for opening the product flow path to permit liquid to be dispensed from the container out of applicator head. The automatic activation/deactivation or closure means further includes a disk-like plug that is moved into sealing relationship with a product flow path between the container and the dispenser head when the cap is installed over the head, and is automatically movable out of the product flow path when the cap is removed from the dispenser head.

BRIEF DESCRIPTION OF THE DRAWINGS

Various features of different embodiments of the invention are described below with reference to the drawings, in which like items are indicated by the same reference designation, wherein.

DETAILED DESCRIPTION OF THE PREFERRED EMBODIMENTS OF THE INVENTION

Figure 1:
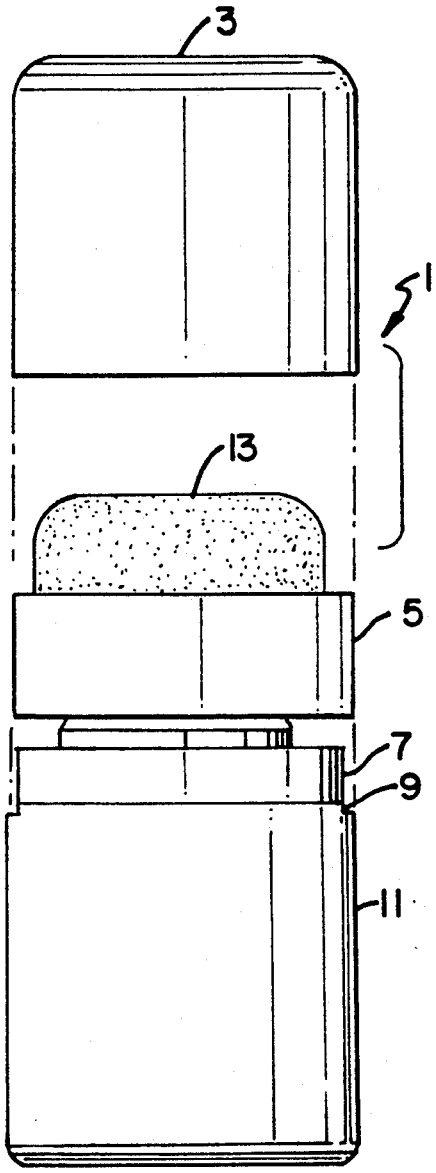
FIG. 1 is a pictorial view showing a dispenser of one embodiment of the invention with an upper portion of its dispenser head in an uppermost position for opening a product flow channel between the dispenser head and the underlying container as a result of removal of a protective cap.

A dispenser of an embodiment of the invention is shown in FIG. 1 in an activated state just after a protective cap 3 has been removed from the dispenser 1. In one embodiment of the invention, the cap 3 is designed to frictionally engage the outside sidewall of an upper dispenser head section 5, and also to fit snugly around the outer circumferential wall of a lower dispenser head section 7, and a relatively small upper portion 9 of a liquid container 11. In this example, a relatively solid or rigid porous liquid applicator head 13 is rigidly attached to the top of the upper dispenser head section 5. As will be described in greater detail below, during removal of cap 3 from dispenser the upper dispenser head section 5 is automatically moved upward and away from the underlying lower dispenser head section 7. Such movement of the former causes the dispenser 1 to be placed in its active or open condition for dispensing liquid from container 11 via the rigid porous applicator head 13, in this example, when the dispenser 1 is inverted.

Figure 2:
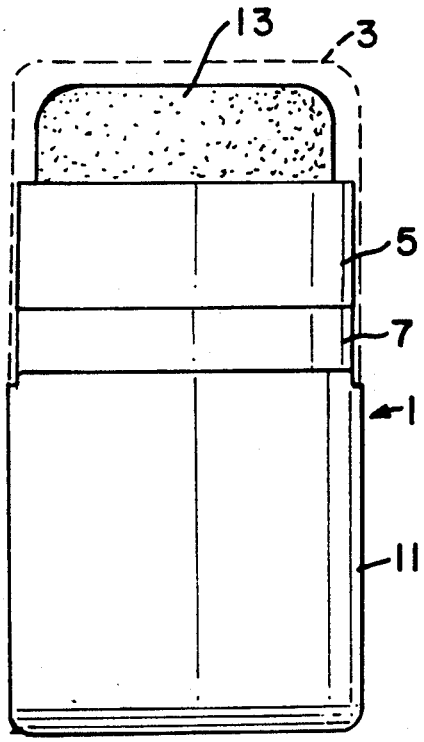
FIG. 2 is a side elevational view of the container and dispensing head assembly of FIG. 1, with the dispenser head shown is its downward-most position for sealing off a product flow channel between the dispensing head and the container.
Figure 3:
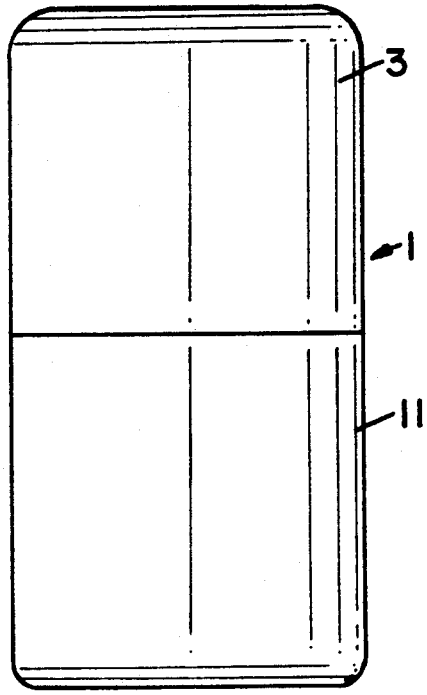
FIG. 3 is a side elevational view showing the dispenser with the cap installed over the dispensing head.

In FIG. 2, the cap 3 shown in phantom, upon dispenser 1. As will described in greater detail below, when cap 3 is so installed on to container 1, because of its frictional engagement with the outsidewall of upper dispenser head section 5, the latter is caused to move downward toward container 11, for placing dispenser 1 in an inactive or closed storage condition. In this closed condition, fluid is prevented from flowing from container 11 through to the applicator head 13. In FIG. 3, the cap 3 is shown in place on dispenser 1.

Figure 4:
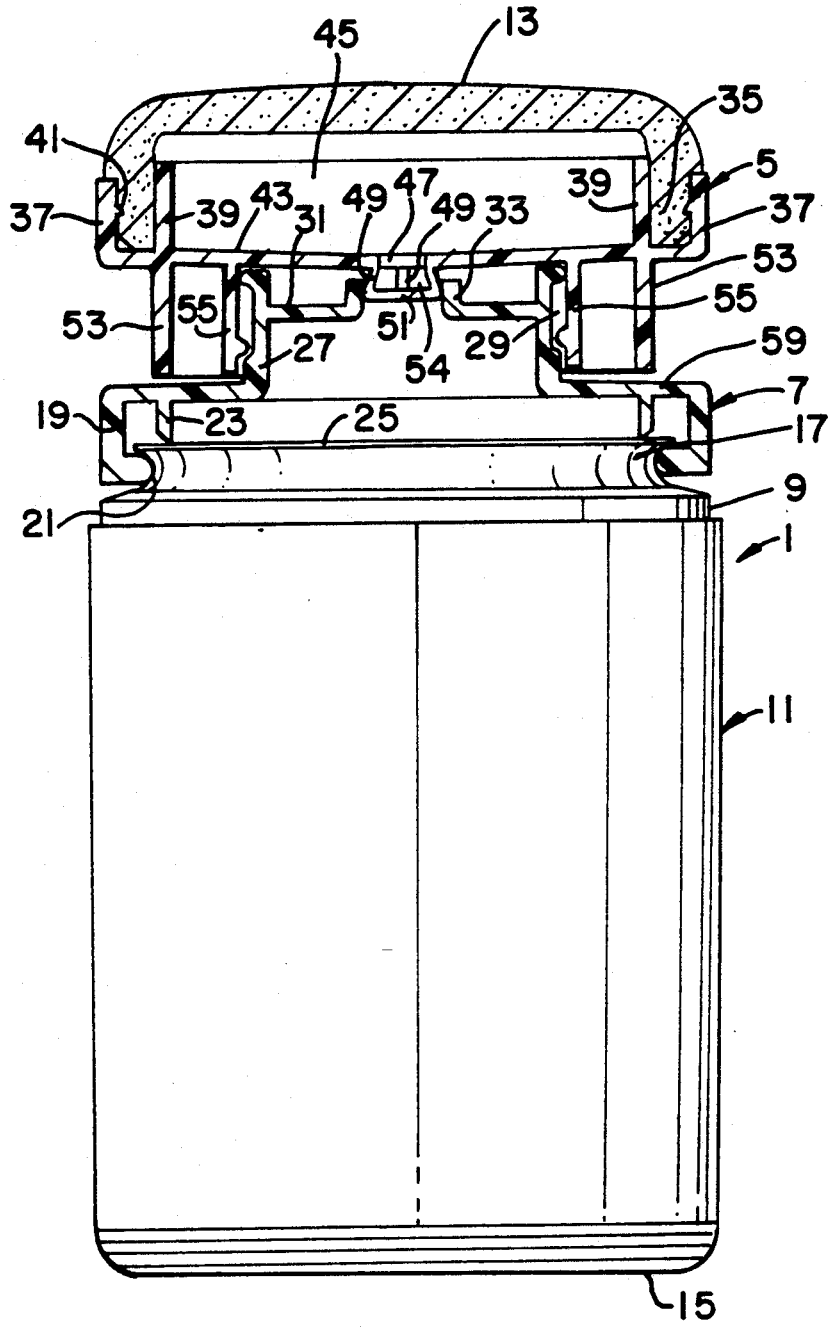
FIG. 4 is a side elevational view showing a cross section of the dispenser head mechanism of one embodiment of the invention installed upon an underlying container.

In FIG. 4, a cross-section of the upper dispenser head section 5 installed upon a lower dispenser head section 7 is shown atop a container 11. Typically, the outer circumferential shape of the container 11 upper and lower dispenser head sections 5 and 7, respectively, and cap 3, will be dictated by the desired shape for the applicator head 13. Round, oval, and/or circular shapes most often given to such applicator heads 13. However, mixed configurations can be utilized for the various elements, if desired.

In this example, the container 11 has a closed bottom 15, and a top portion that has a slightly recessed narrow collar or band-like portion 9, followed by an uppermost recessed channel or groove 17. The lower dispenser head section 7 includes a lowermost sidewall portion 19 that is open at the bottom thereof, and includes a ring-like inwardly projection rib member 21 from the lower inside edge portion of wall 19, for snapping into the channel 17 at the top of container 11, thereby substantially rigidly retaining the lower dispenser head section 7 on container 11. The lower wall 19 of lower dispenser head section 7 opposes an interior and narrower encircling wall portion 23 that rests upon a lip 25 at the top of container 11, and provides rigidity or stiffness to the lower section 7. The lower wall portion 19 reduces to an upper wall portion 27, as shown. The upper wall portion 27 includes a shallow channel 29 about its outside or exterior surface. A disk-like transverse partition 31 is located partially below the inside top edge of upper wall member 27, as shown. A product flow channel or orifice 33 is formed in the center of the disk-like member or partition 31, as shown.

The upper dispenser head section 5 includes a circumferential relatively deep channel or slotway 35 formed between and encircling outer sidewall member 37 and opposing inner wall member 39 for receiving and rigidly retaining a lower portion of the liquid applicator head 13. In this example, the liquid applicator head 13 is a relatively rigid porous head applicator, which consists of polyethylene material. A prototype applicator head 13 was made from Porex XM-1321 material (trade name of Porex Technologies Corp., Fairburn, Ga.), for example. Note that a relatively sharp pointed rib 41 is formed around the inside surface of the outer wall 37 for digging in to the material of the applicator head 13 held within the channel 35, thereby assisting in retaining the applicator head 13 rigidly upon the upper dispenser head section 5.

A partition 43 is located transversely between the interior surfaces of wall member 39. A fluid flow chamber 45 is formed between the top of the partition member 43 and the inside bottom surface of the applicator head 13. Also, a hole 47 is located in the center of the partition 43. A plurality of downwardly projecting arm or strut-like members 49 are spaced apart and connected at one end to the circumferential edge of the hole 47, and at their other ends to a disk-like plug 51. Apertures or open slits 54 are formed between the downwardly projecting struts or mounting fingers 49 for permitting liquid to flow around the plug 51 and into the fluid flow chamber 45, when plug 51 is free of the product flow channel 33, as will be described in greater detail below. The struts 49 are equally spaced from one another.

The upper dispenser head section 5 also includes two spaced apart, opposing, and parallel downwardly projecting wall members 53 providing an outside encircling sidewall, and 55 providing an interior encircling wall. Note as previously mentioned, the configuration of the various wall members and container can be dictated by the shape of the applicator head 13, or can be otherwise configured.

Note that FIG. 4 is shown for the closed or inactive state of the dispenser 1. In this state, the upper dispenser head 5 has been pushed down to its lowermost position upon the lower dispenser head 7, whereby the plug 51 acts to seal off the product flow channel 33, thereby preventing liquid from flowing from container 11 into the fluid flow chamber 45 and onto applicator head 13. A more detailed explanation follows below.

Figure 5:
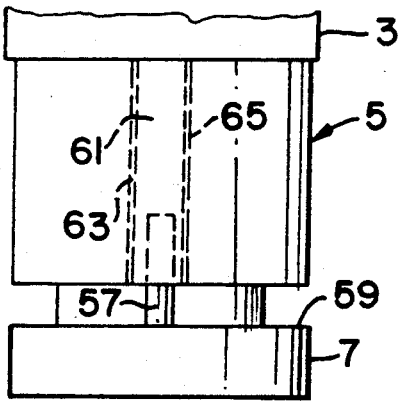
FIGS. 5 and 6 show features of a head anti-rotation mechanism in both the open and closed positions of the dispenser head, respectively, of one embodiment of the invention.
Figure 6:
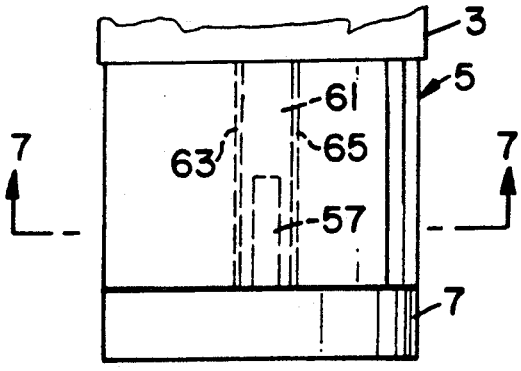
Figure 7:
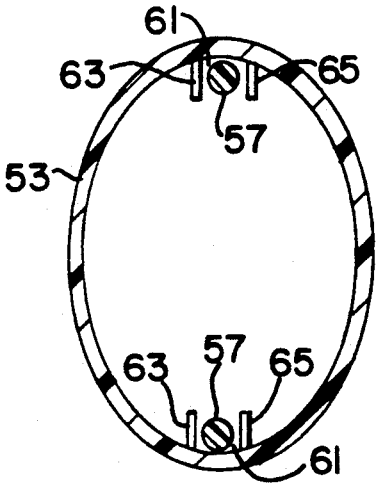
FIG. 7 shows a partial cross sectional view taken along 7—7 of FIG. 6.

An antirotation mechanism for preventing the upper dispenser head 5 from being rotatable upon the lower dispenser head 7 is shown in FIG. 5 for the open or active condition of dispenser 1, and in FIG. 6 for the closed or inactive state of dispenser 1. Note that the figures shown are not to scale relative to other of the figures presented herein. No attempt was made to present any of the figures in a given scale either by themselves or relative to one another, and all of the figures are presented herein for purposes of illustration of the various embodiments of the invention. In describing this antirotation feature, reference is also made to the cross section take along 7—7 of FIG. 6 as shown in FIG. 7. Posts 57 are rigidly mounted on opposing ends of the transverse wall portion 59 of the lower dispenser head section 7. Slots 61 are formed on opposing sides in alignment with the longitudinal axis of the upper dispenser head section 5 on the inside surface of wall member 53. A slot 61 is formed by opposing side members 63 and 65. As shown, the upper dispenser head section 5 is assembled on the lower dispenser head section 7 in a manner placing the posts 57 within their associated slots 61. As a result, even if the dispenser head sections 5 and 7 were made circular, the aforesaid antirotation mechanism will prevent a user from being able to rotate the upper dispenser head section 5 upon the lower dispenser head section 7.

Figure 8:
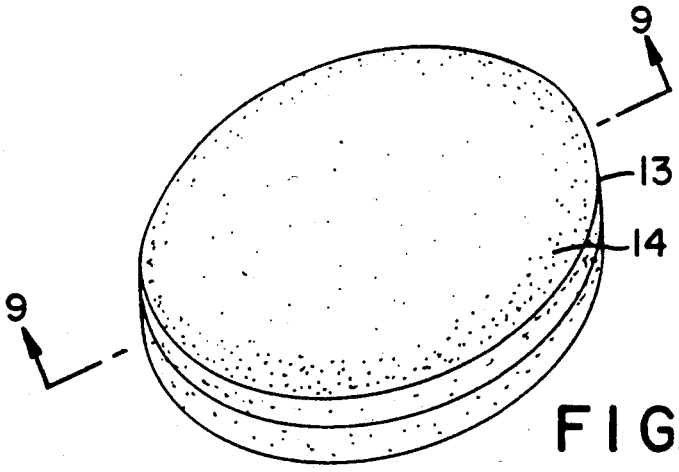
FIG. 8 shows a porous head applicator configuration for one embodiment of the invention.
Figure 9:
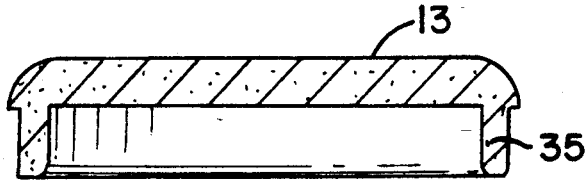
FIG. 9 shows a cross section taken along 9—9 of FIG. 8 of the porous head applicator thereof.
Figure 10:
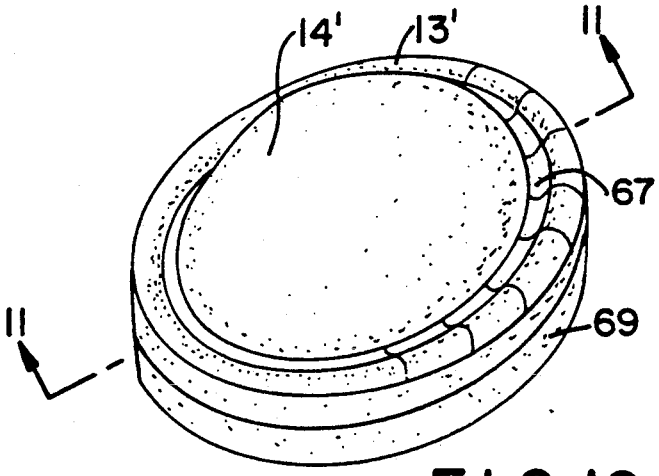
FIG. 10 shows a porous head applicator configuration for another embodiment of the invention.
Figure 11:
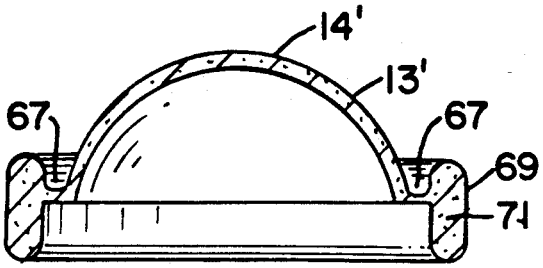
FIG. 11 shows a cross sectional diagram taken along 11—11 of the porous head of FIG. 10.

FIG. 8 shows a pictorial view of a applicator head 13 having a substantially oval configuration. A cross section taken along 9—9 of FIG. 8 is shown in FIG. 9 of the applicator head 13. An alternative configuration for the applicator head is shown in FIG. 10 for an applicator head 13'. Note that applicator head 13 has a substantially flat top 14, whereas the top of applicator head 13' is formed into a dome-like configuration 14'. A circumferential moat-like channel 67 is formed between the bottom of the dome 14' and the side portion 69 for catching any excess liquid that may be dispensed from the dome portion 14'. As will be described below, such excess liquid is returned to container 11. A cross section of the applicator head 14' taken along 11—11 of FIG. 10 is shown in FIG. 11. Note that the lower portion 71 of the side member 69 of applicator head 13' is configured for fitting into the channel 35 of the upper dispenser head 5.

Figure 12:
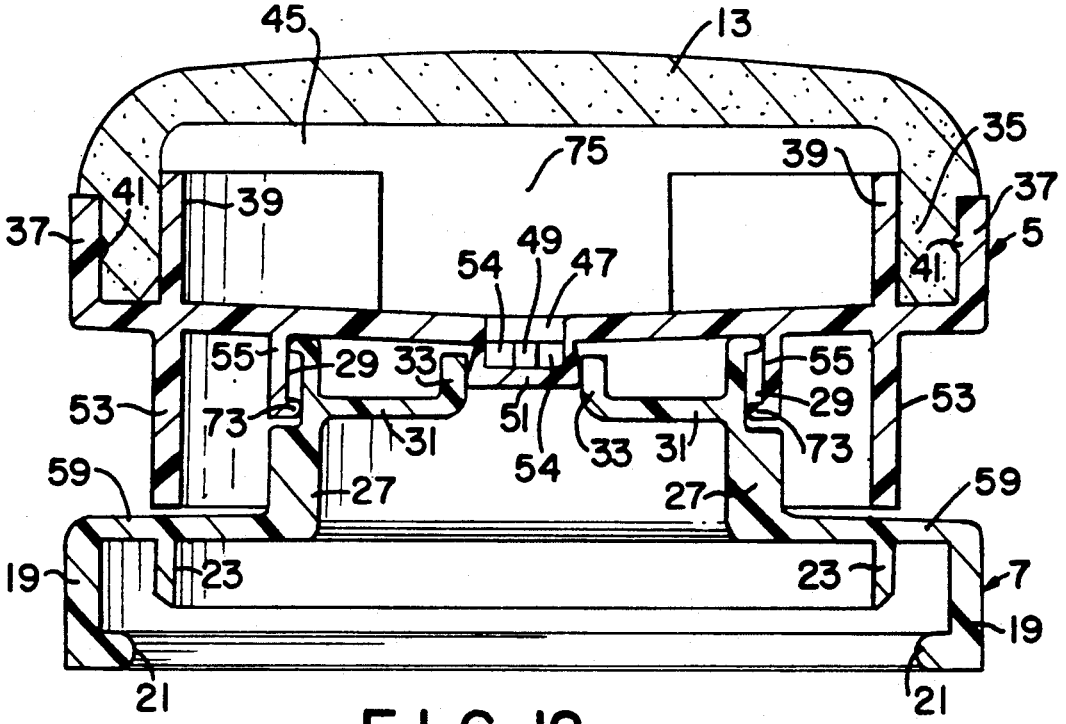
FIGS. 12 and 13 show cross sectional diagrams of the dispensing heads in the open and closed positions, respectively, for one embodiment of the invention.
Figure 13:
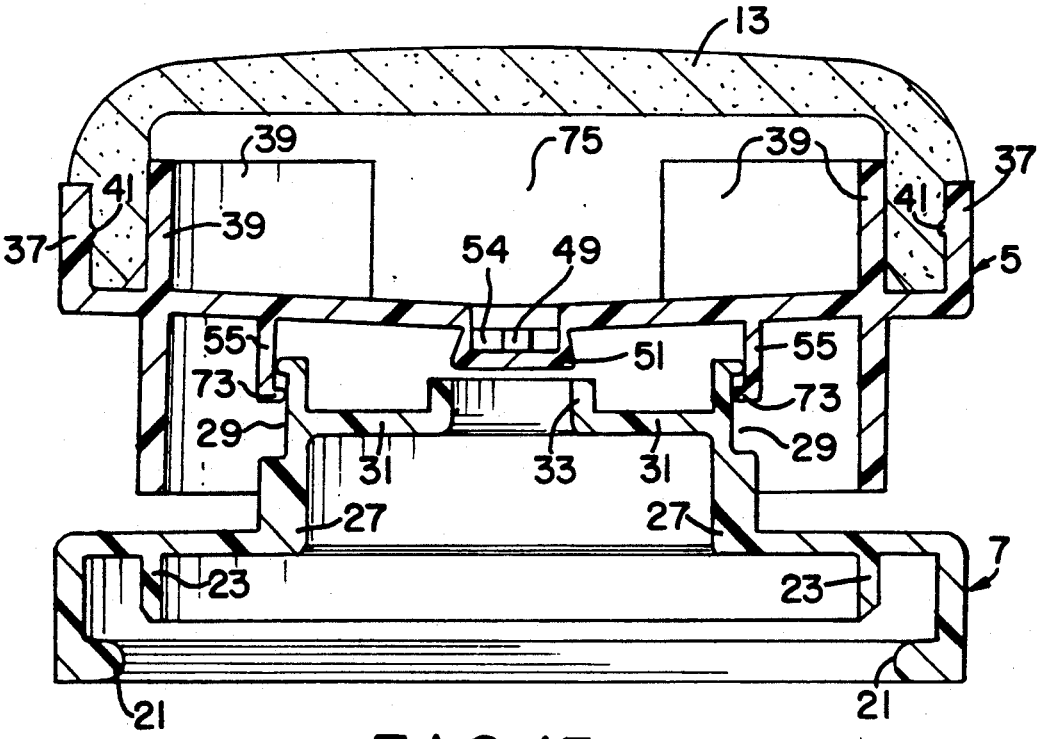

In FIG. 12, in a large detailed cross sectional view is shown of the subassembly of the upper dispenser section 5 to the lower dispenser head 7. Note that the dispenser head sections 5 and 7 are shown in the closed position of FIG. 4, in which the plug 51 is sealing off the product flow channel 33. Note that the wall member 55 of the upper dispenser head section 5 includes a lowermost inwardly protruding rib 73 that is captively retained in the channel 29 of the wall member 27 of the lower dispenser head section 7. In FIG. 13, the upper dispenser head section 5 has been moved upward (note positioning of the protruding rib 73 in the upper portion of channel 29). In this operating or open condition for dispenser 1, the plug 51 has been moved out of and away from the product flow channel 33, thereby permitting liquid to flow from container 11 when dispenser 1 in inverted, through product flow channel 33, past plug 51 and through the aperture 54, into fluid flow chamber 45 and therefrom onto applicator head 13, wetting head 13 for permitting the liquid to be applied to a surface therefrom.

The upper wall 39 is broken into arc-like segments that are spaced apart (see FIG. 16) with spaces 75 therebetween. The reason for providing such spacing 75 is to permit fluid to flow from applicator head 13, for example, back down into the container 11 when the dispenser 1 is placed in an upright position. In this manner, if the applicator head 13 becomes overly saturated with liquid, it can be cleared of such excess fluid by merely placing the dispenser 1 in an upright position upon a surface, prior to placing the cap 3 over the dispensing head sections 5 and 7.

Figure 14:
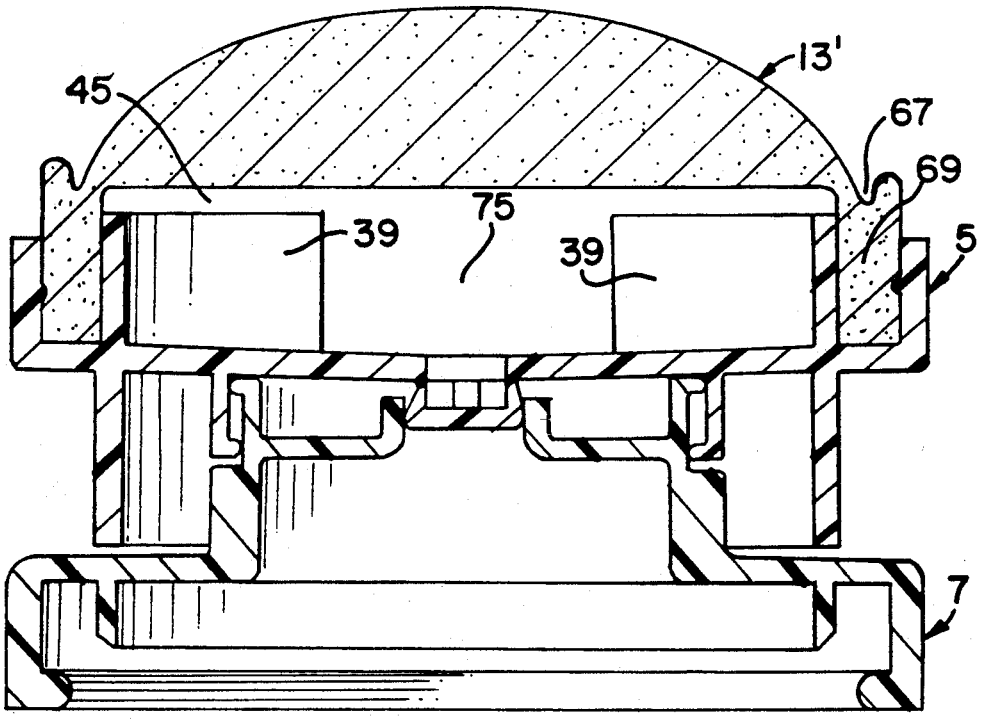
FIGS. 14 and 15 show dispenser heads in the open and closed positions, respectively, for another embodiment of the invention.
Figure 15:
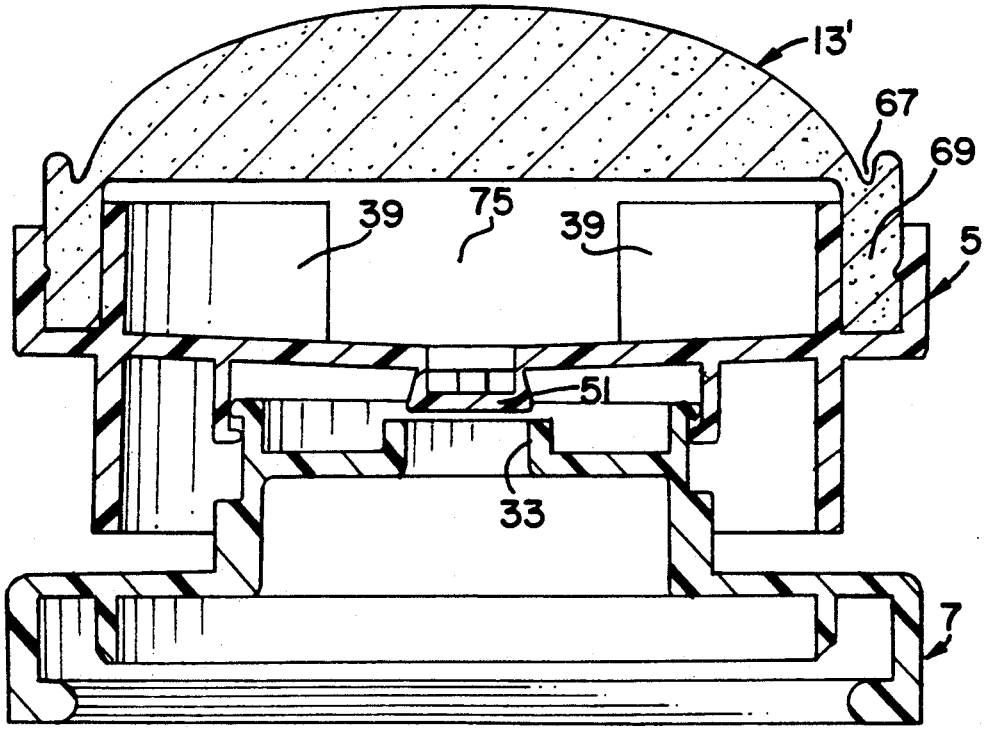

FIGS. 14 and 15 are substantially the same as FIGS. 12 and 13, respectively, with the exception that the applicator head 13 of the latter two figures has been replaced with the alternative applicator head configuration 13'.

Figure 16:
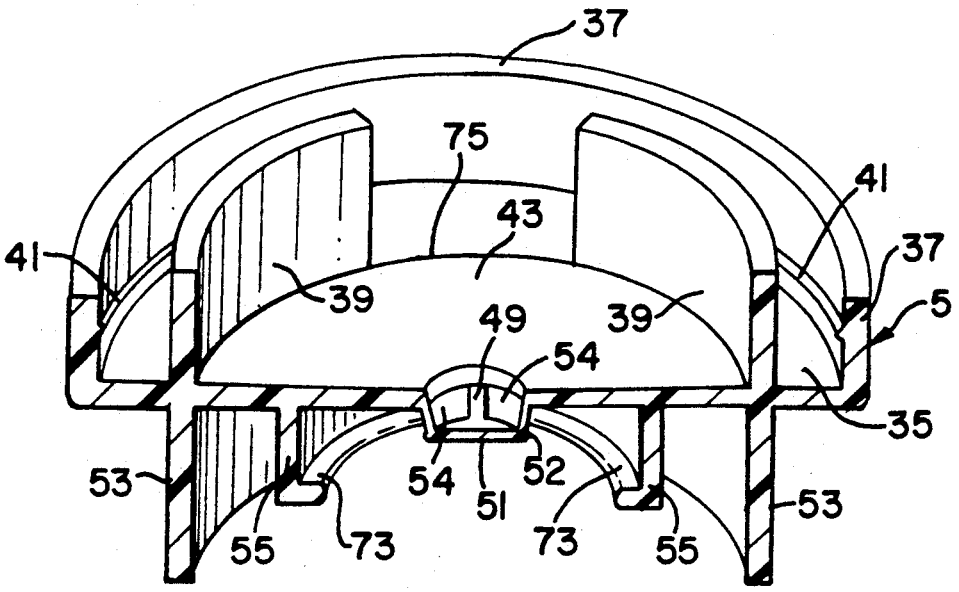
FIG. 16 shows an upper section of a dispenser head mechanism for one embodiment of the invention.
Figure 17:
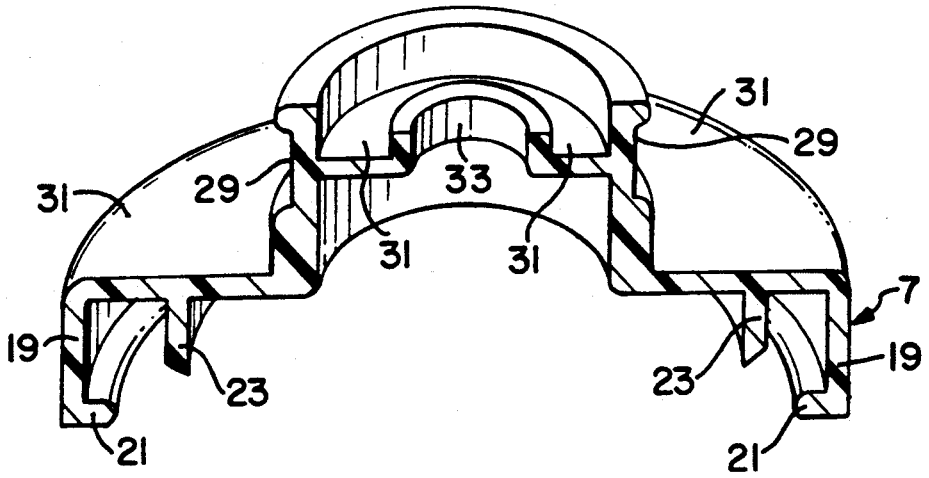
FIG. 17 shows a lower section of a dispenser head mechanism for one embodiment of the invention.
Figure 18:
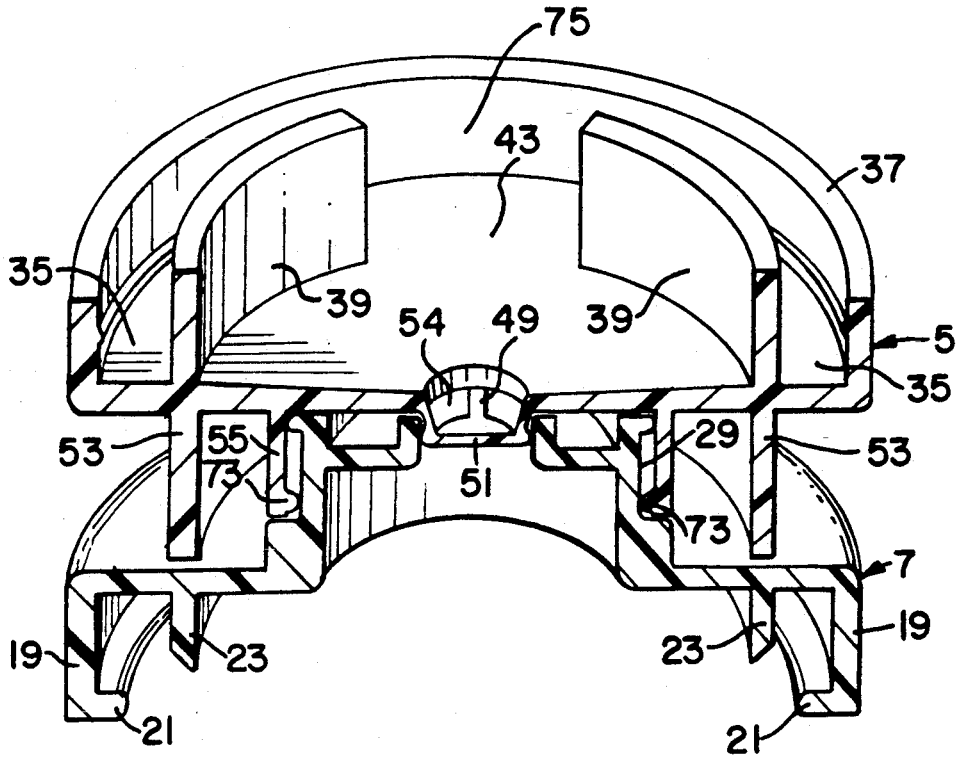
FIG. 18 shows a partial cross sectional view of the mated upper and lower dispenser head members of FIGS. 16 and 17, respectively.

FIGS. 16 and 17 show cross sectional pictorial detailed views of an upper head section 5 and lower head section 7 of one embodiment of the invention. A cross sectional pictorial view of dispenser head sections 5 and 7 as shown in FIGS. 16 and 17 are shown mated together in the cross sectional pictorial view of FIG. 18.

Figure 19:
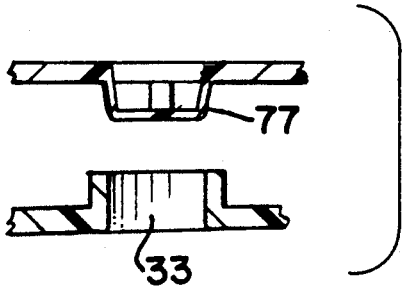
FIG. 19 shows a detailed partial cross sectional view of an alternative embodiment of the invention for providing a plug and sealing means for the dispenser head.

In FIG. 19, a detailed cross sectional is shown of a plug 77 of another embodiment of the invention positioned over a product flow channel 33. The configuration of the plug 77 is shown to have downwardly converging side portions. The maximum outside diameter of plug 77 is made greater than the inside diameter of product flow channel 33. The bottommost outside diameter of plug 77 is made slightly smaller than the inside diameter of product flow channel 33. Accordingly, when plug 77 is moved into the product flow channel 33 it will act to seal off the product flow channel 33. Note in FIG. 16 an alternative configuration for plug 51, wherein it has a lowermost encircling protruding rib 52 for sealing off the product flow channel 33.

The present dispenser 1 can be fabricated from many suitable materials. Polyethylene is suitable for the porous liquid applicator head 13, as previously mentioned. The remainder of dispenser 1 can consist of polypropylene material, for example.

Although various embodiments of the invention have been shown and described herein for purposes of illustration, those of skill in the art may recognize modifications to the same. Any such modifications are meant to be included in the spirit and scope of the appended claims.

What is claimed is:

1. A dispenser for liquids, comprising:

a hand-held container for storing liquid to be dispensed having an open top, and a closed bottom;

a lower dispenser head section rigidly attached to the top of said container, including a centrally located product flow channel;

an upper dispenser head section including a top portion and a bottom portion separated by a partition located transversely between interior surfaces of a common wall member, a liquid flow chamber being formed in said top portion, a hole being locate din the center of said partition, a centrally located disk-like plug, a plurality of downwardly projecting strut-like members spaced apart and each connected at one end of a circumferential edge of said hole, respectively, and opposite ends of said strut-like members being connected about a circumferential edge of said disk-like plug, the spaces between said strut-like members being open for providing a liquid-by-pass for the flow of liquid from said bottom portion, around said plug, through said open spaces into said top portion;

a porous liquid applicator head rigidly affixed to the top portion of said upper dispenser head over said liquid flow chamber thereof; and mounting means for captively mounting said upper dispenser head section upon said lower dispenser head section, for permitting movement of said upper dispenser head section along the longitudinal axis of said container between a first position closest to said container, in which said plug engages and seals off said product flow channel for preventing liquid form flowing therethrough, and a second position away from said container in which said plug is disengaged and slightly above said product flow channel, thereby opening the latter for permitting liquid to flow between said liquid applicator head and said container through a flow path including said liquid flow chamber, the open spaces between said plurality of strut-like members, and said product flow channel.

2. The dispenser of claim 1, wherein said porous head applicator consists of polyethylene material.

3. The dispenser of claim 1, wherein said porous head applicator has an oval shape.

4. The dispenser of claim 1, wherein said porous head applicator is dome shaped, and includes a circumferential channel for catching excess liquid from said porous head applicator, and returning the same to said liquid flow chamber whenever said dispenser is held with said porous head applicator substantially upright.

5. The dispenser of claim 1, further including:

a cap for covering the combination of said lower and upper dispenser head sections; and automatic dispenser opening and closing means, for automatically moving said upper dispenser head section to its first position via installation of said cap thereon, and its second position via removal of said cap therefrom.

6. The dispenser of claim 5, wherein said automatic dispenser opening and closing means includes dimensioning the interior of said cap and exterior of said upper dispenser head section for frictional engagement therebetween.

7. The dispenser of claim 1, wherein said mounting means includes:

said upper dispenser head section further including a collar-like downwardly projecting first wall member below said bottom portion, said wall member being concentric with said plug, and a circumferential rib-like member projecting away from the inside surface of said first wall member; and said lower dispenser head section including a collar-like upwardly projecting second wall member concentric with said product flow channel, with a band-like channel formed as a circumferential depression in the outside surface of said second wall member for receiving and captively retaining said rib-like member of said first wall member of said upper dispenser head section, thereby captively retaining said upper dispenser head section in a manner permitting the latter to move along the longitudinal axis of said container over a distance substantially equal to the length of said band-like channel of said second wall member.

8. The dispenser of claim 1, further including antirotation means for preventing rotation about the longitudinal axis of said dispenser of said upper dispenser head section as mounted upon said lower dispenser head section.

9. The dispenser of claim 8 wherein said antirotation means includes:

at least one slotway aligned in parallel with the longitudinal axis of said dispenser, and formed on an inside surface of an outermost circular wall member of said upper dispenser head; and at least one post rigidly mounted upon said lower dispenser head section, and positioned for being received within the slotway of said upper dispenser head section.

10. The dispenser of claim 1, wherein said upper dispenser head further includes:

an upwardly projecting open slot formed about the circumference of said partition for receiving and rigidly retaining a downwardly projecting circumferential portion of said liquid applicator head, said liquid flow chamber being between the bottom of said liquid applicator head and top of said partition.

11. The dispenser of claim 10, wherein said open slot of said partition is formed between an upward projecting circumferential outer wall about said partition, and an inner wall of spaced apart arc-like segments opposing said outer wall.

12. The dispenser of claim 1, wherein said outer wall about said partition includes a circumferential rib about an inside surface of said outer wall, said rib having a sharp outer edge for biting into a portion of said applicator head retained in said slot.

13. A dispenser for liquids, comprising:

a porous head liquid applicator;

an upper dispenser head section including means located on a top portion for receiving and rigidly mounting said porous head liquid applicator, said upper dispenser head section further including a bottom portion, a liquid flow chamber being formed between said top and bottom portions, a plug, liquid by-pass means for mounting said plug rigidly to and below said bottom portion, while permitting liquid to flow around said plug into and out of said liquid flow chamber, and first connection means rigidly mounted to an underside of said bottom portion;

a hand-held container for storing liquid to be dispensed;

a lower dispenser head section including a bottom portion rigidly attached over an open top of said container, a top portion including a centrally located product flow channel with second connection means thereon for mating with and both captively retaining said first connection means of said upper dispenser head section, and permitting movement of said upper dispenser head section along the longitudinal axis of said dispenser, between a downwardmost first position in which said plug engages and seals off said product flow channel, and an upwardmost second position with said plug above and away form said product flow channel, during use of said dispenser for permitting liquid to flow in a path between said porous head applicator, liquid flow chamber, liquid by-pass means, product flow channel, and said container; and said plug having a disc-like shape, and said liquid by-pass means includes a plurality of elongated relatively narrow struts each having one end rigidly attached to an edge portion of a centrally located hole in the bottom portion of said upper dispenser ahead section, the other ends of said struts being rigidly attached about the outer circumference of said plug, said struts being evenly spaced form one another with apertures being formed therebetween.

14. The dispenser of claim 13, further including a cap for covering said upper and lower dispenser head sections, said cap being adapted for begin pushed on and pulled off of said upper dispenser head section, said cap having an inside diameter dimensioned for permitting said cap to frictionally engage an outside wall of said upper dispenser head section, for upon installation of said cap upon said dispenser moving said upper dispenser head section to its downwardmost position for automatically pushing said plug into said product flow channel for closing or sealing off the latter, and for upon removable of said cap therefrom moving said upper dispenser head section to its upwardmost position for automatically lifting said plug out of said product flow channel, thereby opening said product flow channel.

15. The dispenser of claim 13, further including:

said first connection means of said upper dispenser head section including a first collar-like wall member projecting downwardly from the bottom portion thereof, with a continuous rib-like member projecting away from an inside surface of said wall member; and said second connection means of said lower dispenser head section including a second collar-like wall member concentric with said product flow channel and projecting upwardly, with a circumferential depression in the outside surface of said second wall member providing a channel for receiving and captively retaining said rib-like member of said first wall member of said upper dispenser head section, thereby permitting the latter to move longitudinally between its first and second positions.

16. The dispenser of claim 13, further including:

a side portion of said container including near a top edge a circumferential groove around the container; and said bottom portion of said lower dispenser head section having a continuous sidewall with an inwardly projecting circumferential rib from the inside surface of said sidewall, said rib being adapted for snapping into said groove of said container for rigidly securing said lower dispenser head section to said container.

17. The dispenser of claim 13, further including a topmost circumferential slot formed in opposing upper outer and inner wall members of said upper dispenser head section for receiving a downwardly projecting circumferential sidewall portion of said applicator head, wherein means are included in said slot for rigidly retaining said applicator head.

* * * * *

UNITED STATES PATENT AND TRADEMARK OFFICE

CERTIFICATE OF CORRECTION

PATENT NO. : 5,230,579
DATED : July 27, 1993
INVENTOR(S) : Rennold L. Klawson and Terence J. Franta It is certified that error appears in the above-indentified patent and that said Letters Patent is hereby corrected as shown below:

Column 4, line 45, before "the" insert --1--.

Column 7, line 61, change ""locate din" to located in--.

Column 8, line 15, change "form" to --from--.

Column 9, line 25, change "upward" to --upwardly--.

line 29, change "1" to --11--.

Column 10, line 9, change "ahead" to --head--.

line 12, change "form" to --from--.

line 25, change "removable" to --removed--.

Signed and Sealed this

Nineteenth Day of April, 1994

Bruce Lehman

*Attest:*

BRUCE LEHMAN

*Attesting Officer*

*Commissioner of Patents and Trademarks*